US009656493B2

(12) United States Patent
Bildstein et al.

(10) Patent No.: US 9,656,493 B2
(45) Date of Patent: *May 23, 2017

(54) FIRE CONTROL AND CONTAINMENT IN PRODUCTION PRINTING SYSTEMS WITH RADIANT DRYERS

(71) Applicants: Carl R Bildstein, Lafayette, CO (US); Stuart J. Boland, Denver, CO (US); Scott Johnson, Erie, CO (US); Casey E. Walker, Boulder, CO (US)

(72) Inventors: Carl R Bildstein, Lafayette, CO (US); Stuart J. Boland, Denver, CO (US); Scott Johnson, Erie, CO (US); Casey E. Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/224,971

(22) Filed: Aug. 1, 2016

(65) Prior Publication Data

US 2017/0008321 A1 Jan. 12, 2017

Related U.S. Application Data

(62) Division of application No. 13/468,520, filed on May 10, 2012, now Pat. No. 9,433,809.

(51) Int. Cl.
*A62C 3/00* (2006.01)
*B41J 29/38* (2006.01)
(Continued)

(52) U.S. Cl.
CPC ..... *B41J 29/38* (2013.01); *A62C 2/04* (2013.01); *A62C 3/00* (2013.01); *B41J 29/377* (2013.01)

(58) Field of Classification Search
CPC ..... A62C 2/04; A62C 3/00; A62C 2/24; B41J 29/377; B41J 29/00
USPC ..... 169/60–61, 56, 68, 45, 46, 48–50; 83/358–372; 400/621; 399/91, 385, 386; 352/143–145
See application file for complete search history.

(56) References Cited

U.S. PATENT DOCUMENTS 2,449,716 A * 9/1948 Reney ..... G03B 21/18 352/145
3,753,466 A * 8/1973 Uematsu ..... G03G 15/2007 169/11

(Continued)

*Primary Examiner* — Arthur O Hall
*Assistant Examiner* — Tuongminh Pham
(74) *Attorney, Agent, or Firm* — Duft Bornsen & Fettig, LLP

(57) ABSTRACT

Fire control and containment for a production printing system that includes a dryer unit, an air intake fan, and an exhaust fan. A fire control and containment system includes an enclosure surrounding the dryer unit. The enclosure includes controllable doors, a temperature sensor, and an air pressure sensor in the enclosure. The fire containment and control system also includes a controller operable to detect a fire event based on changes in air pressure and air temperature in the enclosure detected by the air pressure and air temperature sensors. In response to detecting the fire event, the controller closes the doors of the enclosure to prevent the print medium from entering, controls the air intake fan and the exhaust fan to reduce the air pressure in the enclosure, and controls the dryer unit to reduce temperature in the enclosure to suppress fire.

13 Claims, 7 Drawing Sheets

(51) Int. Cl.
*B41J 29/377* (2006.01)
*A62C 2/04* (2006.01)

(56) References Cited

U.S. PATENT DOCUMENTS 5,300,981 A * 4/1994 Shioya ..... G03G 15/2064 399/33
5,486,811 A * 1/1996 Wehrle ..... G08B 17/00 169/23
5,966,836 A * 10/1999 Valdez, III ..... B41F 23/0443 101/424.1
6,125,759 A * 10/2000 Epps ..... F26B 3/283 101/483
6,151,037 A * 11/2000 Kaufman ..... B41J 3/546 347/104
6,266,498 B1 * 7/2001 Oda ..... G03G 15/0194 347/138
6,447,186 B1 * 9/2002 Oguchi ..... B41J 11/0095 400/582
6,505,557 B2 * 1/2003 Desaulniers ..... B41F 31/002 101/216
6,732,651 B2 * 5/2004 Dziedzic ..... B41F 23/044 101/424.1
6,877,247 B1 * 4/2005 DeMoore ..... F26B 3/283 101/419
7,038,390 B2 * 5/2006 Swami ..... H05B 41/39 101/424.1
7,085,510 B2 * 8/2006 Rosenstock ..... G03G 15/2007 399/320
7,549,740 B2 * 6/2009 Yokoyama ..... B41J 11/002 347/101
2007/0153074 A1 * 7/2007 Anderson ..... B41J 11/002 347/102
2007/0283827 A1 * 12/2007 Jung ..... B41F 23/00 101/424.1

* cited by examiner

FIRE CONTROL AND CONTAINMENT IN PRODUCTION PRINTING SYSTEMS WITH RADIANT DRYERS

CROSS-REFERENCE TO RELATED APPLICATIONS

This non-provisional patent application is a divisional of U.S. patent application Ser. No. 13/468,520, filed on May 10, 2012 and titled "FIRE CONTROL AND CONTAINMENT IN PRODUCTION PRINTING SYSTEMS WITH RADIANT DRYERS," which is hereby incorporated by reference, and which claims priority to and thus the benefit of an earlier filing date from U.S. Provisional Patent Application No. 61/485,030 (filed May 11, 2011), the entire contents of which are incorporated by reference.

FIELD OF THE INVENTION

The invention relates to the field of production printing systems and, in particular, to fire safety and fire control of a radiant dryer unit of a production printing system.

BACKGROUND

A production printing system is typically a continuous form printer that prints on paper or some other printable medium that is stored on relatively large rolls, also called a "web" when printing. It is generally a high-speed printer used for volume printing, such as 100 pages per minute or more. These printers typically include a localized print controller that controls the overall operation. These printers also include one or more print engines (sometimes referred to as an "imaging engine" or as a "marking engine") that apply ink to the print medium as directed by the print controller.

The printers are also typically configured with heaters or dryers that are used to evaporate the fluid content of the ink such that the ink attaches to the print medium. In production printing systems, these print dryers usually have multiple elements that radiate heat to the web so as to dry the ink onto the print medium after the print engine applies the ink to the print medium. Certain print dryers, such as infrared dryers, also use air intake and exhaust systems to remove the evaporated carrier fluid of the ink as well as any absorbed heat from the immediate environment. However, excess heat from the print dryer to certain parts of the web can create a fire hazard. For example, areas of the print medium with lower concentrations of ink sometimes dry faster, potentially causing the print medium to be overheated and rendering it more likely to ignite. Additionally, paper dust from the web can propagate through the dryer and catch fire.

These hazards can be compounded if the printer continues to operate during high-temperature events. For example, airflow through the dryer during excessive temperatures can start and fuel a fire creating a dangerous situation for printer personnel. Also, damage to the printer and the more delicate and expensive components of the printer, such as the print controller, are more likely to escalate from continued operation at high temperatures.

SUMMARY

Embodiments described herein provide fire control and containment for a production printing system. The production printing system comprises a dryer unit, an air intake fan, and an exhaust fan. The fire control and containment system includes an enclosure surrounding the dryer unit. The enclosure includes controllable doors through which a print medium passes when open. The fire control and containment system also includes a temperature sensor and an air pressure sensor in the enclosure and a controller operable to detect a fire event based on changes in air pressure and air temperature in the enclosure detected by the air pressure and air temperature sensors. In response to detecting the fire event, the controller is operable to close the doors of the enclosure to prevent the print medium from entering, to control the air intake fan and the exhaust fan to reduce the air pressure in the enclosure, and to control the dryer unit to reduce temperature in the enclosure to suppress fire.

In one embodiment, the fire control and containment system includes a fire extinguishing unit operable to dispense a fire retardant (e.g., halomethane), where the controller is further operable to direct the fire extinguishing unit to dispense the fire retardant during the fire event. The doors may hermetically seal and/or thermally isolate the enclosure from the controller. The doors may also include a blade to cut the print medium and prevent additional print medium from entering the enclosure during the fire event. The controller may be also operable to generate an alarm to alert personnel of the fire event. The fire control and containment system may also include a vent affixed to the exhaust fan to vent the exhaust from an operating environment of the production printing system. The fire control and containment system may also include a humidity sensor, where the controller is further operable to detect the fire event based on humidity detected by the humidity sensor being outside a predetermined range.

The various embodiments disclosed herein may be implemented in a variety of ways as a matter of design choice. For example, the embodiments may take the form of physical machines, computer hardware, software, firmware, or combinations thereof. In another embodiment, a computer readable medium is operable to store software instructions for converting the input data to the color space of the printer. These software instructions are configured so as to direct a processor or some other processing system to operate in the manner described above. Other exemplary embodiments may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
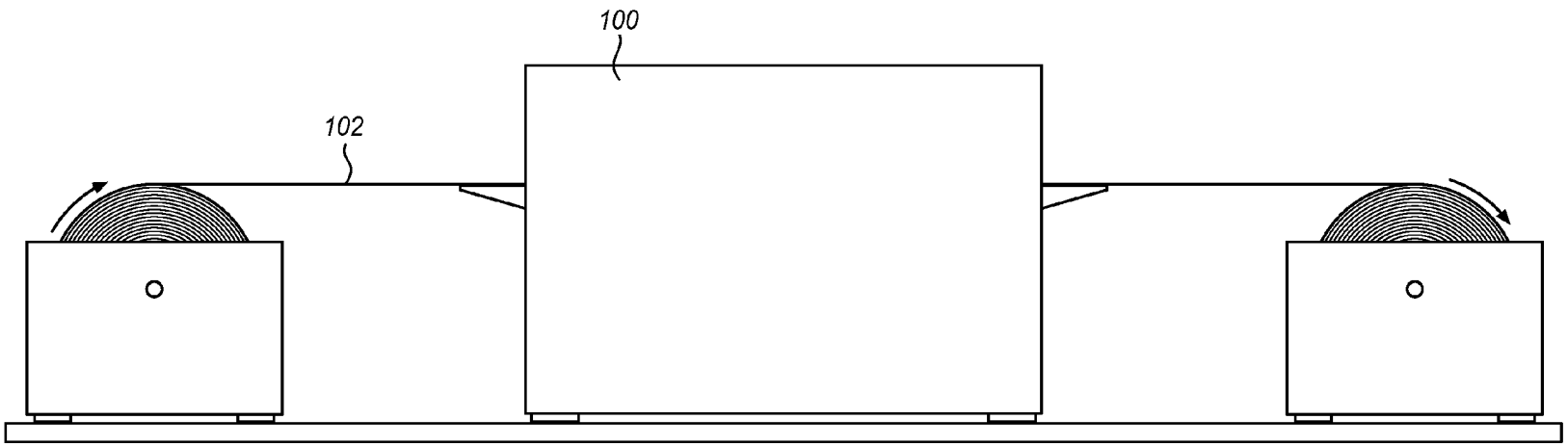
FIG. 1 illustrates an exemplary production printing system.

FIG. 1 illustrates a printing system 100 in an exemplary embodiment. The printing system 100 comprises any continuous-forms printer used to mark a printable medium 102. In this embodiment, the printing system 100 is a production printing system that uses a recording liquid, such as ink, to mark the print medium 102. Although not specifically shown in FIG. 1, the printing system 100 includes a print controller and one or more print engines. The print engines include a print head controller and arrays of print heads that discharge the recording liquid onto the print medium 102 as it passes under the print heads. After a print engine discharges the recording liquid onto the print medium 102, the printing system 100 may use a radiant dryer unit that assists in drying the recording liquid on the print medium 102.

Figure 2:
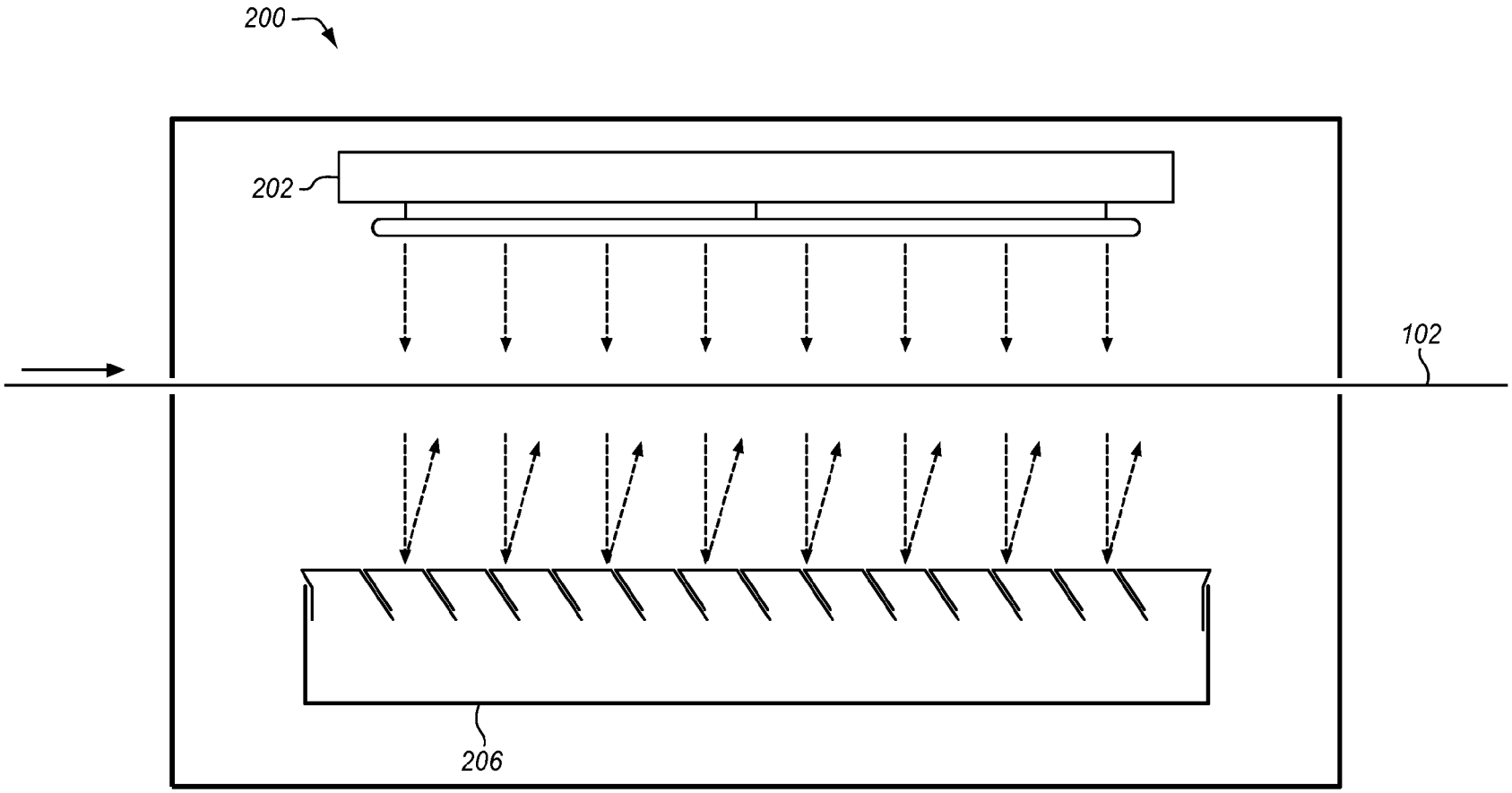
FIG. 2 illustrates an exemplary dryer unit of the production spring system.

FIG. 2 illustrates a dryer unit 200 in an exemplary embodiment. The dryer unit 200 is installed in the printing system 100 after the print heads to dry the recording liquid that is printed on the print medium 102. The dryer unit 200 includes a light source 202 that projects light onto the print medium 102. For example, the light source 202 may comprise one or more arrays of lamps or light bulbs. The light waves from the light source 202 are illustrated as dotted arrows in FIG. 2. The radiant energy in the light waves helps to dry ink on the print medium 102 as the print medium 102 passes through the dryer unit 200. Some of the light waves may pass through or pass by the print medium 102 during the drying process. Thus, the dryer unit 200 may also include a reflector element 206 that is opposite the light source 202 (i.e., on the other side of print medium 102). The reflector element 206 acts to reflect the light waves that pass through or around the print medium 102 back towards the print medium 102 to assist in the drying process. Of course, this is just one example of a dryer unit used in a production printing system. Various forms of dryer units exist that may be implemented with a production spring system. Accordingly, the invention is not intended to be limited to any particular type of dryer unit.

Figure 3:
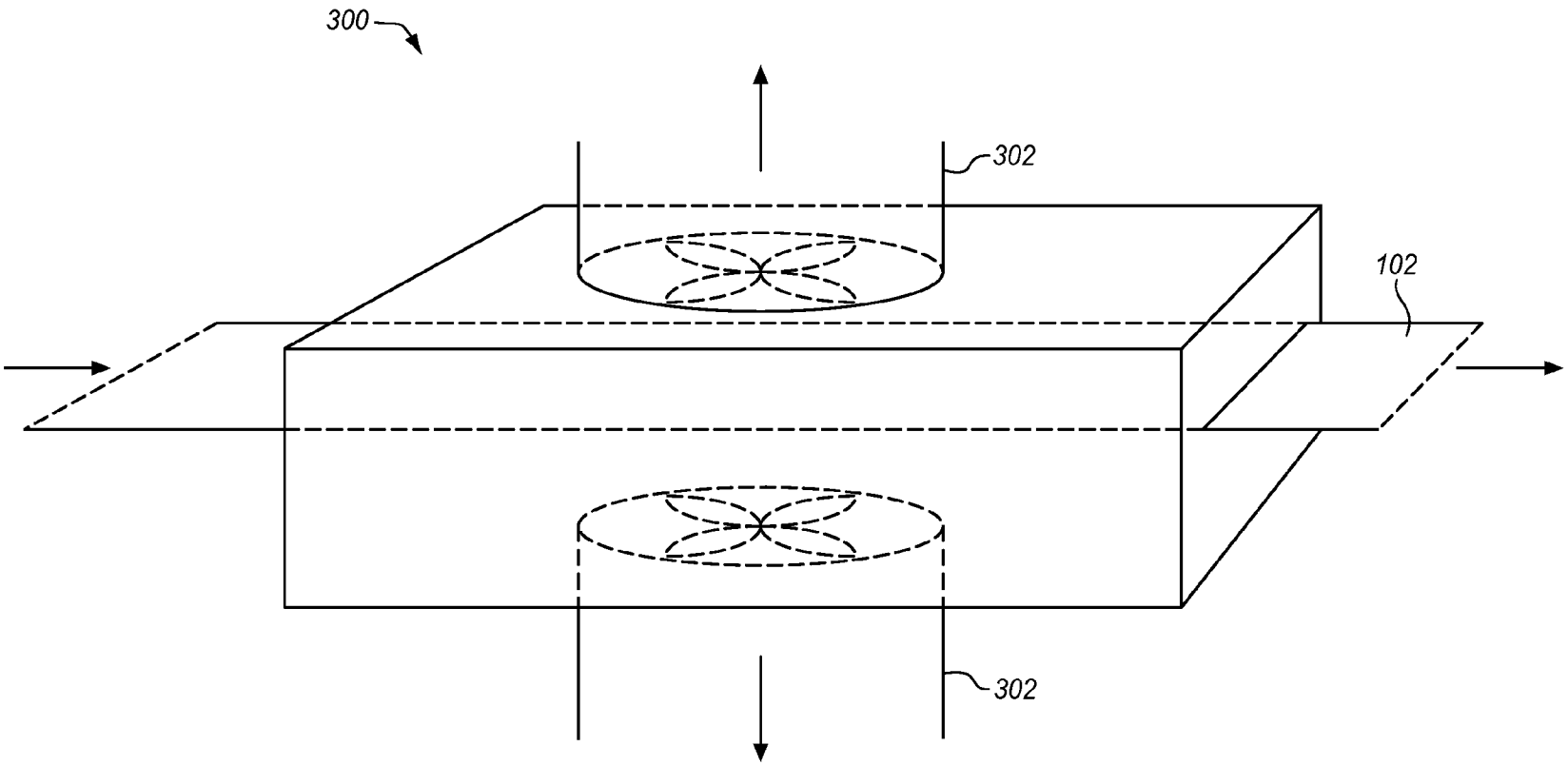
FIG. 3 illustrates an exemplary exhaust unit of the production printing system.

FIG. 3 illustrates an exemplary exhaust unit 300 of the production printing system 100. Generally, the exhaust unit 300 is configured with one or more fans 302 that are operable to exhaust heated air and vapors of the drying process. As such, the exhaust unit 300 is typically configured after the dryer unit 200. In this example, there is an upper fan 302 and a lower fan 302 to exhaust heated air from both sides of the print medium 102 and the surrounding enclosure as the print medium passes through. The fans 302 are typically connected to a vent of the building in which the production printing system is located to vent the heated air and vapors away from the production printing system.

Figure 4:
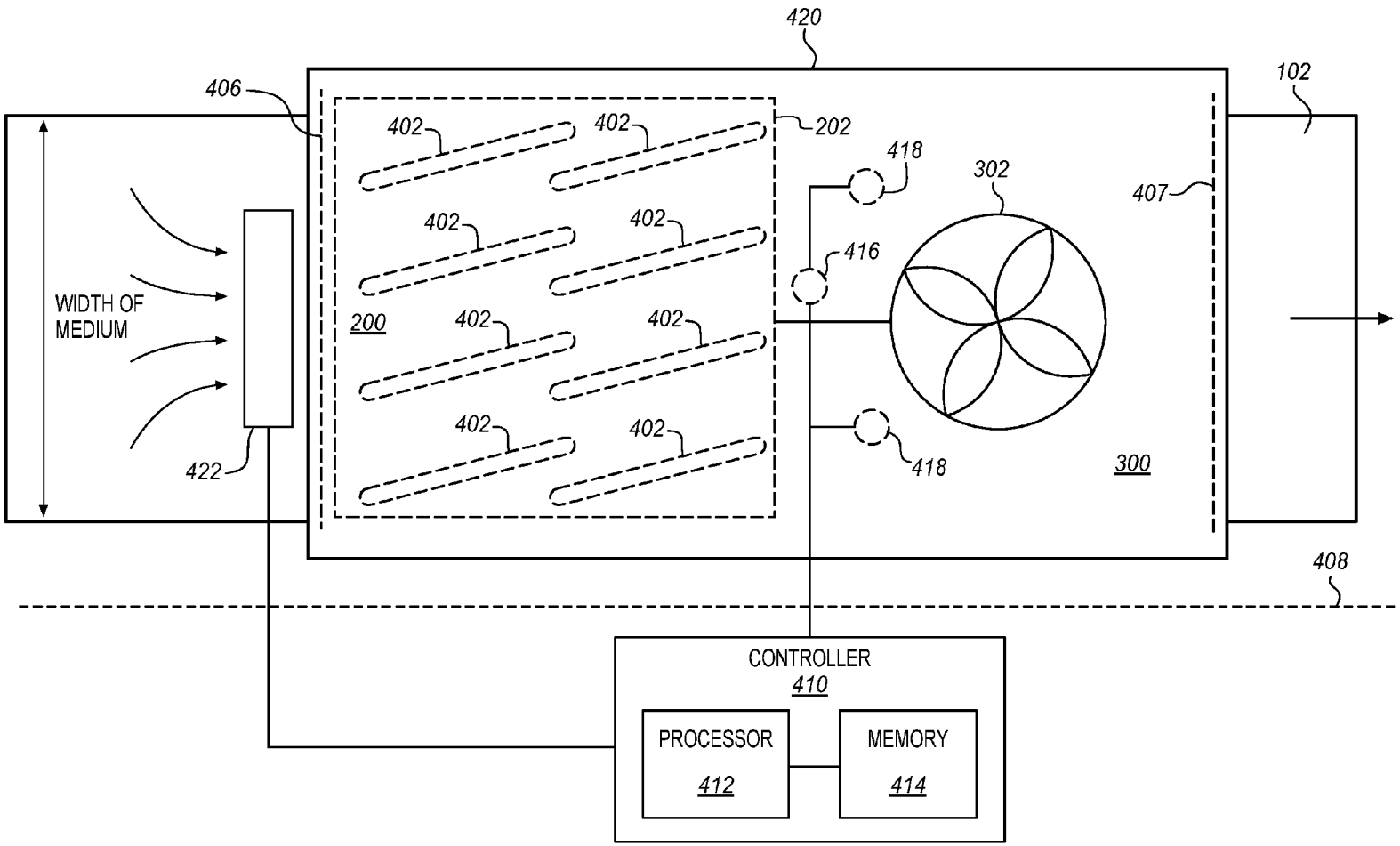
FIG. 4 illustrates an exemplary fire control and containment system of the production printing system.

FIG. 4 illustrates an exemplary fire control and containment system of the production printing system 100. The fire control and containment system is implemented with a controller 410 in combination with the dryer unit 200 and the exhaust unit 300. The dryer unit 200 and the exhaust unit 300 may form an enclosure 420 that thermally isolates a fire event from other parts of the production spring system 100 as well as the controller 410 used to implement the fire control and containment system.

The controller 410 may use various sensors 418 to detect conditions within the dryer unit 200 and/or the exhaust unit 300 that are indicative of a fire event. The processor 410 may use this information to control the temperature within the enclosure 420 via the control of the dryer unit 200 and the exhaust unit 300.

FIG. 4 exemplarily illustrates the light source 202 for the dryer unit 200 as a top view showing the print medium 102 passing underneath the light source 202 of the dryer unit 200 and through the exhaust unit 300. In this embodiment, the light source 202 of the dryer unit 200 includes an array of lamps 402 that spans across the width of the print medium 102. A lamp as described herein comprises any element that produces light. However, other forms of radiant heat may be used.

Also illustrated in FIG. 4 are enclosure doors 406 in 407 that are controllably operated by the controller 410 to prevent air (e.g., from air intake fan 422) and the print medium 102 from entering the enclosure 420. Additionally, the door 406 and/or the door 407 may be configured with blades that slice the print medium 102 to prevent extra material of the print medium 102 from entering into the enclosure 420 during a fire event and thus prevent fuel from entering the fire. In one embodiment, the enclosure 420 may use hermetic seal 408 to seal the enclosure from other components of the production printing system 100 and the fire control and containment system (e.g., the controller 410). For example, the fire control and containment system may also include a fire extinguishing module 416 that is operable to disperse fire retardant (e.g., halomethane, or "Halon") into the enclosure 420 during a fire event. The hermetic seal 408 may prevent the fire retardant from affecting printer personnel and/or the other components of the production process and 100.

The controller 410 includes a processor 412 and a memory 414. The memory 414 may store information on the fixed operating power of each lamp 402 in the light source 202 so as to control temperature of the dry unit 200. The memory 414 may further store information on the intensity of light emitted by each lamp (or array of lamps) when energized by its fixed operating power. The processor 412 executes the desired operational steps of the controller 410, which is further illustrated in FIG. 5.

Figure 5:
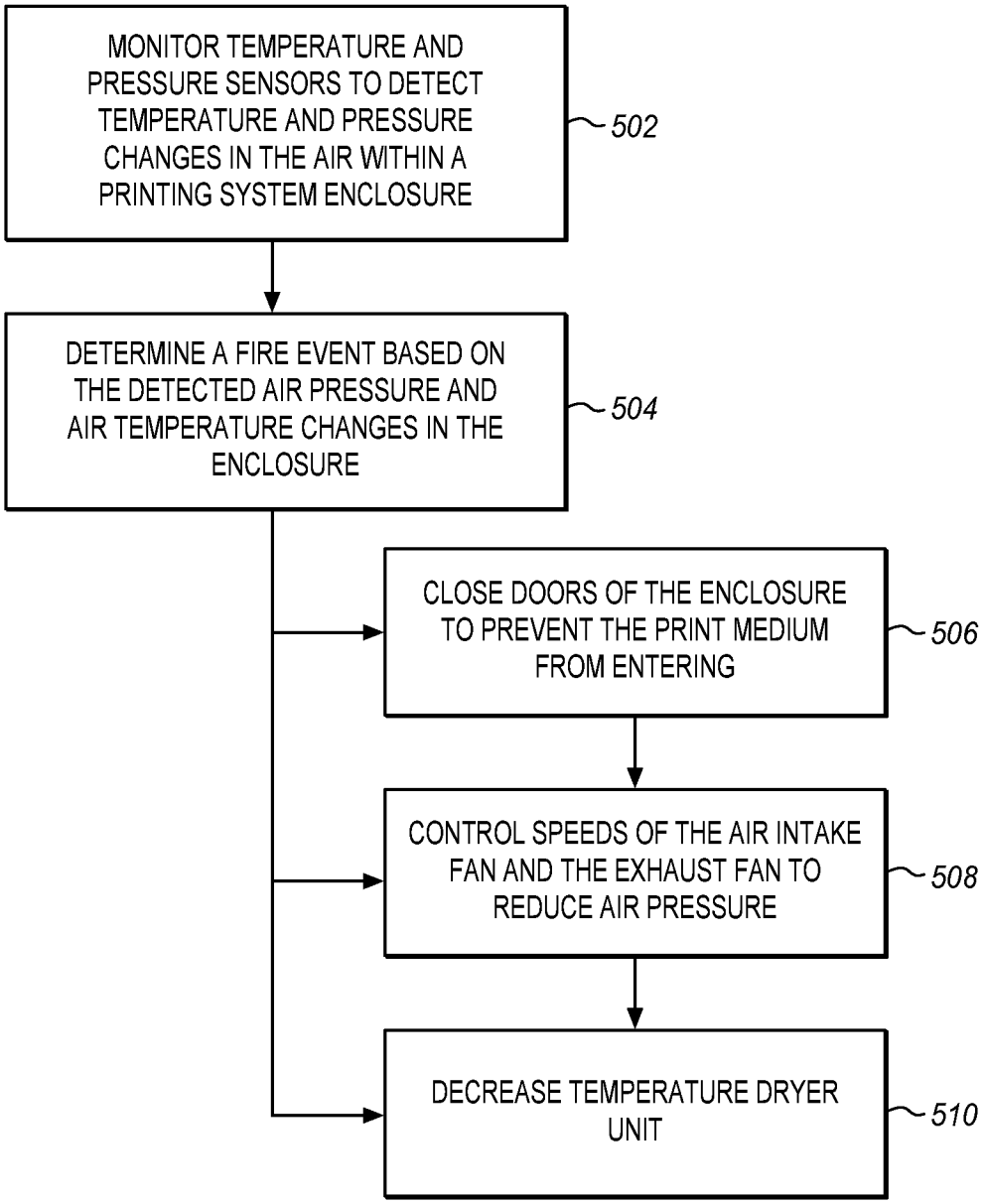
FIG. 5 is a flowchart illustrating an exemplary method of operating the fire control and containment system.

FIG. 5 is a flowchart illustrating an exemplary method 500 of operating the fire control and containment system. The method 500 initiates when the production printing system begins printing onto the print medium 102. The controller 410, during the printing process, monitors temperature and pressure sensors within the enclosure 420 to detect temperature and pressure changes in the air within the enclosure 420, in the process element 502. The controller 410 detects a fire event based on the detected air pressure and air temperature changes within the enclosure, in the process element 504. For example, the memory 414 may store operating parameters for various types of print medium 102. As directed by the controller 410, the dryer unit 200 and the exhaust unit 300 then operate according to the operating parameters for the print medium 102 being used. When the detected air temperature and air pressure changes in the enclosure 420, the controller 410 compares the changes to the operating parameters to determine whether the changes are outside the normal operating parameters of the print medium 102. If so, the controller 410 may determine that a fire within the enclosure 420 has caused the air temperature and air pressure to change. Accordingly, the controller 410 may initiate fire control procedures based on that determination.

The controller 410 initiates fire control to suppress fire within the enclosure 420 by closing doors of the enclosure 420 to prevent the print medium 102 from entering the enclosure 420, in the process element 506. To reduce air pressure within the enclosure 420, the controller 410 decreases a speed of the air intake fan 422 to reduce the amount of air intake to the enclosure 420 and increases a speed of the exhaust fan 302 of the exhaust unit 300 to increase the rate of exhaust from and decrease air pressure within the enclosure 420, in the process element 508. Preventing additional material of the print medium 102 from entering the enclosure 420 and removing air from the enclosure 420 results in the removal of fuel for the fire and thus starves the fire. The controller 410 also decreases a temperature of the dryer unit 200, in the process element 510, to further assist in suppressing the fire.

Figure 6:
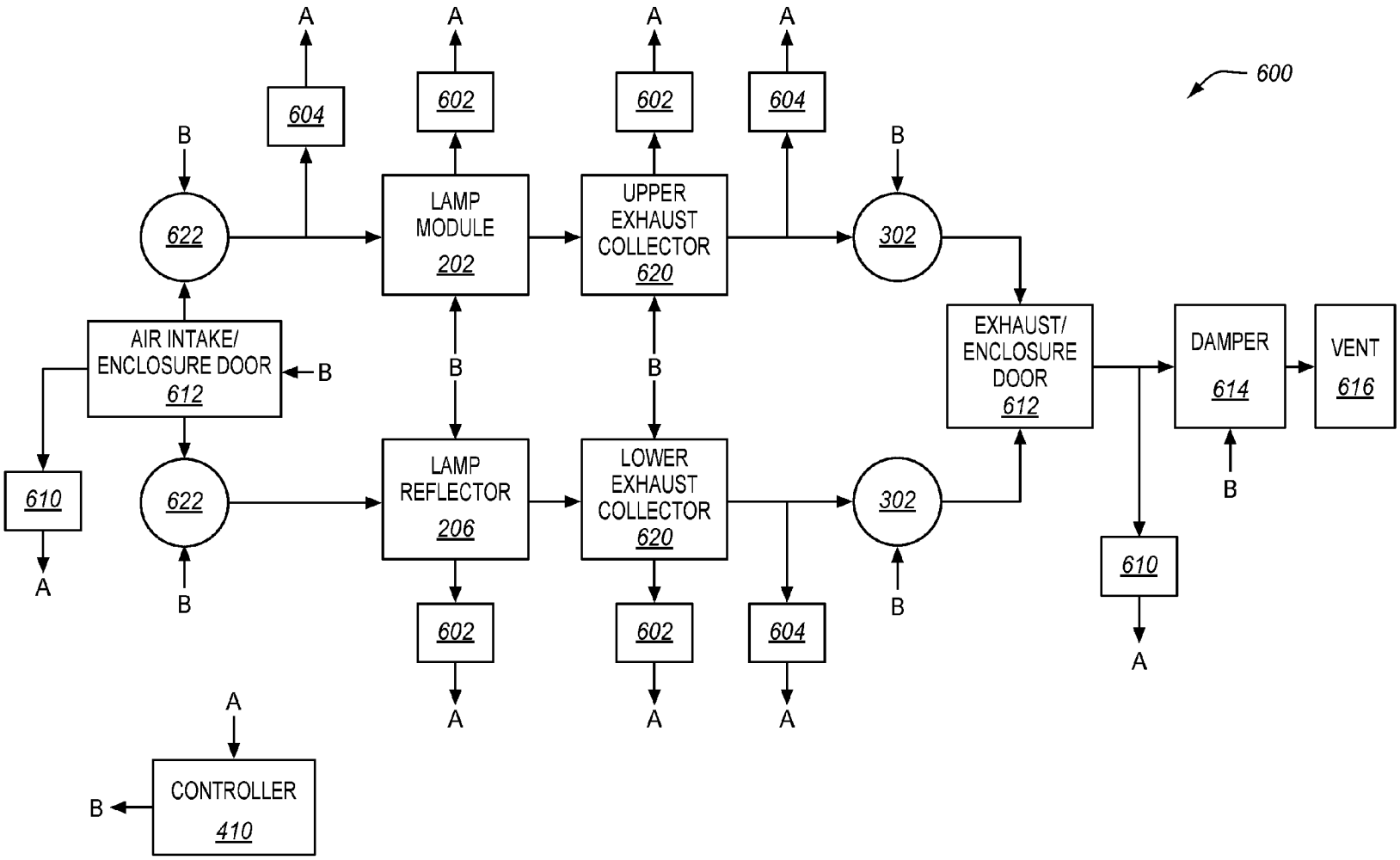
FIG. 6 is a block diagram of an exemplary fire control and containment system.

FIG. 6 is a more detailed block diagram of an exemplary fire control and containment system operable with the production printing system 100. As with the embodiment illustrated in FIG. 4, the fire control and containment system 600 is configured with the controller 410 in combination with the lamp module 202, the lamp reflector 206, and the upper and lower fans 302 of the exhaust unit 300. In this embodiment, four temperature sensors 602 and three air pressure sensors 604 are configured within the enclosure 420 to monitor operating conditions of the production printing system 100 as it relates to the dryer unit 200. A humidity sensor 610 is also configured outside the enclosure 420 to measure differences between the inside of the enclosure 420 and the outside of the enclosure 420. All inputs from the sensors 602, 604, and 610 to the controller 410 are represented by the arrows with "A", whereas the control outputs to various components (e.g., lamp module 202, the lamp reflector 206, the exhaust fan 302, etc.) from the controller 410 are represented by the arrows with "B".

On the upper portion of the driver unit 200/exhaust unit 300, one temperature sensor 602 is operable to monitor the temperature of the lamp module 202 and another temperature sensor 602 is operable to monitor an upper exhaust collector 620 of the exhaust unit 300. On the lower portion of the driver unit 200/exhaust unit 300, one temperature sensor 602 is operable to monitor the temperature of the lamp reflector 206 and another temperature sensor 602 is operable to monitor a lower exhaust collector 620 of the exhaust unit 300.

Two exhaust collectors 620 retain particulate emissions resulting from the drying process. For example, paper dust from the print medium 102 may enter into the dryer unit 200 and create a potential fire hazard. The exhaust fans 302 draw the air through the upper and lower exhaust collectors 620 where particulates, such as dust, are trapped. As this material may be flammable, the temperature sensor 602 are configured to monitor the temperature at those exhaust collectors 620. Air and any remaining gases/particulates are vented through the vent 616 of the operating environment for the production printing system 100 (e.g., a building's ventilation system).

Air intake fans 622 are positioned at the air intake/enclosure door 612 to pull air through the enclosure 420 and assist in the drying process of the lamp module 202 and the lamp reflector 206 (e.g., by removing humidity during the drying process and/or any particulates). The air pressure sensors 604 are configured to monitor various air flows through the enclosure 420 to ensure that the production printing system 100 is operating within prescribed operating parameters. For example, the air pressure sensor 604 proximate to the upper air intake fan 622 may be operable to detect the air intake pressure to determine whether the air pressure near the lamp module 202 and the lamp reflector 206 is within operational parameters for drying. Generally, the air intake pressure and pressure at the lamp reflector 206 should be slightly higher than ambient to overcome air intake restrictions and facilitate airflow into the enclosure.

The air pressure sensors 604 may also be operable to provide information during a fire event. For example, if a fire occurs during printing, the controller 410 may shut the air intake/enclosure door 612 and decrease the speeds of air intake fans 622 to decrease the amount of air intake into the enclosure 420. By continually monitoring the air intake with the air pressure sensors 604, the controller 410 can ensure that the measures to decrease air intake are indeed effective.

The air pressure sensors 604 configured after the upper and lower exhaust collectors 620 may be operable to ensure that the exhaust fans 302 are operating within certain parameters. For example, if a fire event is detected by the controller 410, the controller 410 may direct the exhaust fans 302 to increase their speeds to remove as much air from the fire as possible. In this regard, the exhaust/enclosure door 612 may close at some time after the air intake enclosure door 612 is closed so as to vent as much air as possible from the enclosure 420. When the air pressure sensors 604 at the exhaust end of the enclosure 420 indicate an air pressure that is sufficient to suppress a fire, the exhaust/enclosure door 612 may close to hermetically seal the lamp module 202 and the lamp reflector 206 from other components within the production printing system 100 (e.g., the controller 410, a print controller, a print engine, etc.).

The humidity sensor 610 is operable to measure humidity outside the enclosure 420. Humidity levels may be used by the controller 410 to detect possible fire events. For example, if the humidity level of the operating environment for the production printing system 100 is below a certain level, the controller 410 may determine that such a level creates a potential fire hazard. In this regard, the controller 410 may issue an alarm indicative of the potential for the fire. The controller 410 may also decrease the temperature of the enclosure 420 by decreasing the amount of radiant heat from the lamp module 202 and/or by increasing the speed of the fans 622 and 302. As mentioned, the sensor 610 may also be configured to measure the relative difference between the inside of the enclosure 420 and the outside of the enclosure 420. For example, the humidity sensor 610 may also be operable to measure the air pressure and temperature outside the enclosure 420 for comparison to air pressure and temperature measurements by the sensors 602 and 604 within the enclosure 420. Generally, air pressure external to the enclosure 420 should be slightly lower than the ambient pressure within the enclosure 420 during operation. If the air pressure external to the enclosure 420 rises past this point, a controlled damper 614 may be adjusted by the controller 410 to achieve such. For example, the opening of the damper 614 may be reduced for a higher than specified vacuum building exhaust. If the external air pressure is above ambient, then an error condition may be indicated by the controller 410 due to inadequate ventilation.

Under normal operating conditions, the average air pressure within the enclosure 420 proximate to the air intake fans 622 is less than the pressure external to the enclosure 420. If the average air pressure within the enclosure 420 exceeds the air pressure external to the enclosure 420, speeds of the air intake fans 622 are adjusted to correct the condition. If this condition still exists after a certain time, then the controller 410 may direct the lamp module 202 to shut down while the fans 622 remain active to cool the air inside the enclosure 420 until the temperature sensors reach a predetermined level for printing operations. The controller 410 may also generate an error such that personnel may address the problem (e.g., through a display module not shown).

The controller 410 is operable to independently control each of the components within the fire control and containment system 600, including the lamp module 202 and the lamp reflector 206, based on predetermined air flow rate ranges and temperature points. The controller 410 may continuously calculate and store optimized set points for control based on system control inputs. For example, drying characteristics may differ from one print medium to another. The optimal drying characteristics of a particular print medium may be ascertained after the print medium has passed through the production printing system 100. The controller 410 may be operable to process this information and control speeds of the fans 622 and 606 to adjust when changes in air intake filter restriction and reflector component emissivity are encountered. The controller 410 may also automatically compensate for overdriven building exhaust. For example, the vent 616 may be operable to exhaust a certain amount of air from the production printing system 100. The controller 410 may reduce the speed of the fans 622 and/or 606 when the air production from the production printing system 100 has exceeded that amount. It should be noted that this independent control of the fans and lamps is not necessarily limited to fire control and containment as such may be implemented as part of maintenance and/or general operation. For example, the lamps and fans disclosed herein may be controlled based on the drying characteristics of the print medium and not just in response to a detected fire event.

In one embodiment, the controller 410 is also operable to determine characteristics of the print medium 102 as it enters the production printing system 100 for use in the determination of potential fire hazards. For example, if the speed and/or tension of the print medium 102 falls below a certain level, the controller 410 may determine that the print medium is being exposed to the lamp module 202 for too long, resulting in a potential fire hazard from the print medium being overheated. Accordingly, the controller 410 may generate an alarm to indicate problems associated with the feed of the print medium 102. The controller 410 may also control the various components of the production printing system 100 as indicated above. In one embodiment, the controller 410 may even cut the print medium 102 such that no additional print medium passes between the lamp module 202 and the lamp reflector 206. Once the print medium 102 is cut, additional material from the print medium 102 may flow from the feed to a bin or other device capable of holding the material until the feed can be stopped.

In addition to preventing and suppressing fire, the controller 410 may use all the various inputs from the sensors for maintenance purposes. For example, if the temperature cannot be decreased within the enclosure 420 by increasing the speeds of the air intake fans 622 and/or the exhaust fans 302, the controller 410 may determine that the fans 622/302 and/or the lamp module 202 are not operating properly. In this regard, the controller may alert production printing personnel to the problems such that the components may be inspected and repaired if necessary. The controller 410 may also be operable to prevent operation of the production printing system 100 and certain components of the production printing system 100 are not enabled. For example, if the dryer unit 200 is not turned on, the controller 410 may direct the entire production printing system 100 to suspend printing operations until the dryer unit 200 is operational. In this regard, the controller 410 may prevent the feed of the print medium 102 through the production printing system 100.

The invention can take the form of an entirely hardware embodiment, an entirely software embodiment or an embodiment containing both hardware and software elements. In one embodiment, the invention is implemented in software, which includes but is not limited to firmware, resident software, microcode, etc.

Figure 7:
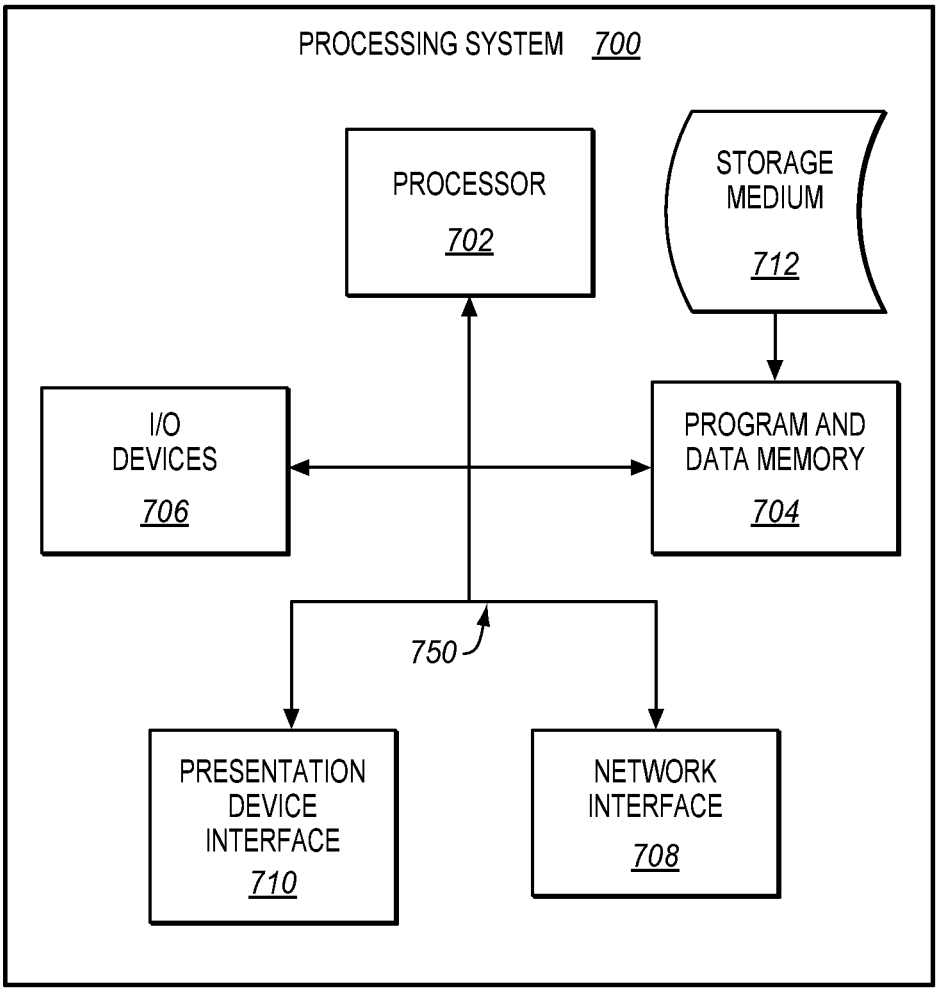
FIG. 7 is a block diagram of a computer system operable to execute computer readable medium embodying programmed instructions to perform desired functions in an exemplary embodiment.

FIG. 7 is a block diagram depicting a processing system 900 also operable to provide the above features by executing programmed instructions and accessing data stored on a computer readable storage medium 712. In this regard, embodiments of the invention can take the form of a computer program accessible via the computer-readable medium 712 providing program code for use by a computer or any other instruction execution system. For the purposes of this description, computer readable storage medium 712 can be anything that can contain, store, communicate, or transport the program for use by the computer.

The computer readable storage medium 712 can be an electronic, magnetic, optical, electromagnetic, infrared, or semiconductor device. Examples of computer readable storage medium 712 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

The processing system 700, being suitable for storing and/or executing the program code, includes at least one processor 702 coupled to memory elements 704 through a system bus 750. Memory elements 704 can include local memory employed during actual execution of the program code, bulk storage, and cache memories that provide temporary storage of at least some program code and/or data in order to reduce the number of times the code and/or data are retrieved from bulk storage during execution.

Input/output (I/O) 706 (including but not limited to keyboards, displays, pointing devices, etc) can be coupled to the processing system 700 either directly or through intervening I/O controllers. Network adapter interfaces 708 may also be coupled to the system to enable the processing system 700 to become coupled to other processing systems or storage devices through intervening private or public networks. Modems, cable modems, IBM Channel attachments, SCSI, Fibre Channel, and Ethernet cards are just a few of the currently available types of network or host interface adapters. Presentation device interface 710 may be coupled to the system to interface to one or more presentation devices, such as printing systems and displays for presentation of presentation data generated by processor 702.

Although specific embodiments are described herein, the scope of the invention is not limited to those specific embodiments. The scope of the invention is defined by the following claims and any equivalents thereof.

We claim:

1. A method of controlling and containing fire in a production printing system that comprises a dryer unit, an air intake fan, and an exhaust fan, method comprising:

monitoring air pressure and air temperature sensors to detect temperature and pressure changes in the air within an enclosure surrounding the dryer unit;

detecting a fire event based on the detected air pressure and air temperature changes in the enclosure; and upon detecting the fire event:

closing doors of the enclosure to prevent the print medium from entering the enclosure;

decreasing a speed of the air intake fan; and increasing a speed of the exhaust fan to reduce air pressure in the enclosure to a level sufficient to suppress a fire.

2. The method of claim 1, further comprising:

initiating a fire extinguishing unit to dispense a fire retardant within the enclosure during the fire event.

3. The method of claim 1, further comprising:

sealing the enclosure from an operating environment of the production printing system.

4. The method of claim 1, further comprising:

generating an alarm to alert personnel of the fire event.

5. The method of claim 1, further comprising:

cutting the print medium to prevent additional print medium from entering the enclosure during the fire event.

6. The method of claim 1, wherein detecting the fire event further comprises detecting humidity outside a predetermined range.

7. A non-transitory computer readable medium comprising instructions that, when executed by a controller, direct the controller to control and contain fire in a production printing system that comprises a dryer unit, an air intake fan, and an exhaust fan, the instructions further directing the controller to:

monitor air pressure and air temperature sensors to detect temperature and pressure changes in the air within an enclosure surrounding the dryer unit;

detect a fire event based on the detected air pressure and air temperature changes in the enclosure; and upon detecting the fire event:

close doors of the enclosure to prevent the print medium from entering the enclosure;

decrease a speed of the air intake fan; and increase a speed of the exhaust fan to reduce air pressure in the enclosure to a level sufficient to suppress a fire.

8. The non-transitory computer readable medium of claim 7 the instructions further directing the controller to initiate a fire extinguishing unit to dispense a fire retardant within the enclosure during the fire event.

9. The non-transitory computer readable medium of claim 7 the instructions further directing the controller to hermetically seal the enclosure from the controller.

10. The non-transitory computer readable medium of claim 7, the instructions further directing the controller to initiate cutting of the print medium to prevent additional print medium from entering the enclosure during the fire event.

11. The non-transitory computer readable medium of claim 7, the instructions further directing the controller to determine the fire event based on a detection of humidity outside a predetermined range.

12. The non-transitory computer readable medium of claim 7, the instructions further directing the controller to calculate and store optimized set points for control based on system control inputs to adjust for changes in air intake filter restriction and reflector component emissivity.

13. The non-transitory computer readable medium of claim 7, the instructions further directing the controller to control speeds of the air intake fan and the exhaust fan to automatically compensate for overdriven building exhaust.

* * * * *